US010477326B2

(12) United States Patent
Miyasaka et al.

(10) Patent No.: US 10,477,326 B2
(45) Date of Patent: Nov. 12, 2019

(54) SIGNAL PROCESSING DEVICE AND SIGNAL PROCESSING METHOD

(71) Applicant: SOCIONEXT INC., Kanagawa (JP)

(72) Inventors: Shuji Miyasaka, Osaka (JP); Kazutaka Abe, Osaka (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 15/413,821

(22) Filed: Jan. 24, 2017

(65) Prior Publication Data

US 2017/0134867 A1 May 11, 2017

Related U.S. Application Data

(63) Continuation of application No. PCT/JP2015/003311, filed on Jul. 1, 2015.

(30) Foreign Application Priority Data

Jul. 24, 2014 (JP) ..... 2014-150687

(51) Int. Cl.
*H04R 25/00* (2006.01)
*H04R 3/04* (2006.01)
(Continued)

(52) U.S. Cl.
CPC ..... *H04R 25/353* (2013.01); *H04R 25/502* (2013.01); *H04R 25/558* (2013.01);
(Continued)

(58) Field of Classification Search
CPC ..... H04R 25/00
(Continued)

(56) References Cited

U.S. PATENT DOCUMENTS 4,629,834 A * 12/1986 Waggoner ..... H04R 25/502 367/199
4,982,434 A * 1/1991 Lenhardt ..... H04R 25/606 381/316
(Continued)

FOREIGN PATENT DOCUMENTS

CN 1297230 A 5/2001
CN 101529732 A 9/2009
(Continued)

OTHER PUBLICATIONS

International Search Report issued in International Patent Application No. PCT/JP2015/003311, dated Aug. 18, 2015; with partial English translation.
(Continued)

*Primary Examiner* — Suhan Ni
(74) *Attorney, Agent, or Firm* — McDermott Will & Emery LLP

(57) ABSTRACT

A signal processing device, comprising a high band attenuation filter which attenuates a signal component in a bandwidth of frequency higher than at least a predetermined frequency in an audio signal that is input, and a hearing aid processor which performs hearing aid processing on a signal output from the high band attenuation filter, wherein the predetermined frequency is determined according to the upper limit of a target bandwidth of frequency for hearing aid.

7 Claims, 10 Drawing Sheets

(51) Int. Cl.
*G10L 21/0364* (2013.01)
*G10L 19/26* (2013.01)

(52) U.S. Cl.
CPC ..... *G10L 19/26* (2013.01); *G10L 21/0364* (2013.01); *H04R 3/04* (2013.01); *H04R 25/356* (2013.01); *H04R 2225/55* (2013.01)

(58) Field of Classification Search
USPC ..... 381/312, 315–318
See application file for complete search history.

(56) References Cited

U.S. PATENT DOCUMENTS 5,479,522 A * 12/1995 Lindemann ..... H04R 25/356 381/23.1
6,115,478 A * 9/2000 Schneider ..... H04R 25/70 381/312
6,169,813 B1 * 1/2001 Richardson ..... H04R 25/353 381/312
6,173,062 B1 * 1/2001 Dibachi ..... H04R 25/353 381/312
6,236,731 B1 * 5/2001 Brennan ..... H03H 17/0266 381/312
6,240,192 B1 * 5/2001 Brennan ..... H04R 25/505 381/312
6,339,647 B1 * 1/2002 Andersen ..... H04R 25/407 381/312
6,347,148 B1 * 2/2002 Brennan ..... H04R 25/453 381/312
6,407,972 B1 6/2002 Koyata et al.
6,868,163 B1 * 3/2005 Goldstein ..... H04R 25/356 381/312
7,031,484 B2 * 4/2006 Ludvigsen ..... H04R 25/70 381/312
8,014,550 B2 * 9/2011 Bramslow ..... H04R 25/356 381/312
2006/0188115 A1 * 8/2006 Lenhardt ..... H04R 25/353 381/312
2008/0118085 A1 5/2008 Shioda
2012/0224611 A1 * 9/2012 Baheti ..... H03M 7/30 375/219

FOREIGN PATENT DOCUMENTS

JP H10-260695 A 9/1998
JP H10-304277 A 11/1998
JP 2002-152625 A 5/2002
JP 2003-230071 A 8/2003
JP 2008-131383 A 6/2008
JP 2011-010246 A 1/2011
WO 2008/052575 A1 5/2008

OTHER PUBLICATIONS

Written Opinion issued in International Patent Application No. PCT/JP2015/003311, dated Aug. 18, 2015; with partial English translation.
International Search Report issued in International Patent Application No. PCT/JP2015/003311, dates Aug. 18, 2015; with partial English translation.
Chinese Office Action dated Dec. 29, 2018 for the corresponding Chinese patent application No. 201580040863.4; with partial English translation.
Ding Dalian, Jiang Tao and Yuan Weidong; Science of the Inner Ear'; Science and technology of China press, Jan. 31, 2010, pp. 346-354; with partial English translation (cited in the Chinese Office Action dated Jul. 1, 2019, or the corresponding Chinese Patent Application No. 201580040863.4.
Office Action dated Jul. 1, 2019 for the corresponding Chinese patent application No. 201580040863.4 (with English translation of the Examiners opinion in the Office Action).

* cited by examiner

SIGNAL PROCESSING DEVICE AND SIGNAL PROCESSING METHOD

CROSS REFERENCE TO RELATED APPLICATIONS

This is a continuation application of PCT International Application No. PCT/JP2015/003311 filed on Jul. 1, 2015, designating the United States of America, which is based on and claims priority of Japanese Patent Application No. 2014-150687 filed on Jul. 24, 2014. The entire disclosures of the above-identified applications, including the specifications, drawings and claims are incorporated herein by reference in their entirety.

FIELD

The present disclosure relates to signal processing devices and signal processing methods for performing hearing aid processing to broadband audio signals output from television sets, optical disk (digital versatile disc (DVD)) players, and Blu-ray (registered trademark) disc (BD)) players.

BACKGROUND

FIG. 7 is a diagram illustrating a basic operation of hearing aid processing. The upper spectrum in FIG. 7 represents a waveform of a signal before the hearing aid processing. The lower spectrum in FIG. 7 represents a waveform of the signal of the upper spectrum in FIG. 7 subjected to the hearing aid processing. In other words, the basic operation of the hearing aid processing amplifies amplitudes of signals having small amplitudes and maintains the amplitudes of signals having large amplitudes. The hearing aid processing thus compensates for the sense of hearing of people who have narrowed dynamic ranges for perception of sounds (or normally hear loud sounds but do not hear small sounds).

Techniques in application to television have been developed which provide contents in such a manner that listeners who need hearing aid processing (hereinafter, referred to as an elderly person) and listeners who do not need hearing aid processing (hereinafter, referred to as a healthy person) enjoy the contents together at the same time. For example, Patent Literature 1 discloses the following techniques.

According to a first technique, default sounds not subjected to the hearing aid processing are output from one (for example, left) speaker, and sounds subjected to hearing aid processing are output from the other (for example, right) speaker; thereby, sounds appropriately adjusted for elderly persons are provided from the right speaker.

According to a second technique, default sounds not subjected to the hearing aid processing are output from left and right speakers, and sounds subjected to the hearing aid processing are output from a highly directional speaker separately disposed; thereby, sounds appropriately adjusted for elderly persons are provided from the highly directional speaker.

According to a third technique, default sounds not subjected to the hearing aid processing are output from left and right speakers, and sounds subjected to the hearing aid processing are output from a headphone; thereby, sounds appropriately adjusted for elderly persons are provided from the headphone.

CITATION LIST

Patent Literature

Patent Literature 1: Japanese Patent Application Laid-Open No. 2003-230071

SUMMARY

Technical Problem

Sounds output from recent television sets, however, are composed of broadband signals having a sampling frequency of 48 kHz (bandwidth of reproduction: 24 kHz), and contain a significantly large amount of signals in the bandwidths which do not need hearing aid processing. FIG. 8 is a diagram illustrating target bandwidths of frequency in broadband signals. As illustrated in FIG. 8, a bandwidth of about 10 kHz at most requires the hearing aid processing. Considering such a bandwidth, the sounds output from television sets have an excessively wide bandwidth of frequency.

For example, FIG. 9 is a diagram illustrating examples of frequency components which obstruct the hearing aid processing. (a) of FIG. 9 illustrates a spectrum of a waveform of a sound having a signal having a small amplitude at Time A. (b) of FIG. 9 illustrates a spectrum of a frequency component at Time A of the signal in the waveform of the sound represented by (a) of FIG. 9. (c) of FIG. 9 illustrates a spectrum of a waveform of a sound including a signal which has a large amplitude and is present at Time A. (d) of FIG. 9 illustrates a spectrum of a frequency component of the signal at Time A in the waveform of the sound represented by (c) of FIG. 9.

In the case where the signal at Time A in (a) of FIG. 9 is mainly composed of signal components in a low bandwidth of frequency as illustrated in (b) of FIG. 9, the signal having a small amplitude at Time A is subjected to the hearing aid processing to be amplified to have a large amplitude. However, in the case where the signal having a large amplitude at Time A overlaps the signal having a small amplitude as in illustrated in (c) of FIG. 9 and has a signal component in a high bandwidth of frequency as illustrated in (d) of FIG. 9, the signal component in the high bandwidth of frequency is detected as a signal having a large amplitude. In other words, the conventional techniques inhibit the amplification of signal components in a low bandwidth of frequency, which should be amplified. For easy understanding, the audio signal illustrated in (c) and (d) of FIG. 9 is generated by artificially adding a signal component having a high frequency to the audio signal at Time A in (a) and (b) of FIG. 9. Actual contents often contain uttered lines overlapped by metallic background noises. In such cases, the phenomenon described in FIG. 9 occurs.

This tendency is more remarkable in contents in optical disks. Since the sampling frequency of the sounds contained in the contents of optical disks is not only 48 kHz but also 96 kHz or 192 kHz, the sounds contained in the contents of optical disks contain a large amount of signal components in a very high bandwidth of frequency. These signal components in a high bandwidth of frequency inhibit the amplification of the signal components in a bandwidth of frequency which should be amplified.

Patent Literature 1 discloses the three techniques as a method of providing contents in such a manner that healthy persons and elderly persons enjoy the contents together at the same time. These techniques have the following problems.

In the first technique, sounds reproduced from the signals output from the left speaker and the signals output from the right speaker, one of which are subjected to the hearing aid processing, are mixed in the space, and are not appropriately provided to the target healthy persons and elderly persons, respectively.

The second technique requires a highly directional speaker separately disposed, leading to an increase in cost of apparatuses.

The third technique requires that elderly persons should put on headphones, leading to a sense of detachment of the elderly persons from their families who gather and enjoy the same TV programs together.

Inexpensive apparatuses for wireless connection, such as Bluetooth (registered trademark) connection, of speakers by radio waves are commercially available these days. For example, such an apparatus is disposed on the lap of an elderly person, and signals subjected to the hearing aid processing are fed to the apparatus. Normal sounds are fed to the speakers of the main audiovisual apparatus. The sounds subjected to the hearing aid processing are thereby reproduced only in the area near the elderly person. These three problems above are all solved.

Unfortunately, these wireless speakers degrade the sound quality because audio signals are compression encoded by a compression method (such as SubBand Codec (SBC), or Advanced Audio Coding (AAC)) in the frequency domain before transmission of signals on wireless radio waves. FIG. 10 is a spectrum illustrating the target bandwidth of frequency of broadband signals for bit assignment in the compression encoding. Namely, in the compression method in the frequency domain, an input signal having a wide bandwidth of frequency leads to broad and shallow bit assignment during encoding as illustrated in FIG. 10. For this reason, sufficient bit assignment is not performed on target signal components for hearing aid having low frequencies, degrading signals subjected to the hearing aid processing.

The present disclosure has been made in consideration of the problems in the related art. An object of the present disclosure is to provide a signal processing device and a signal processing method which perform hearing aid processing on broadband audio signals output from television sets and optical disk players with high precision, and perform compression encoding the signals subjected to the hearing aid processing while keeping high quality of sounds to be reproduced.

Solution to Problem

To solve these problems, the signal processing device according to one aspect of the present disclosure includes a high band attenuation filter which attenuates at least a signal component in a bandwidth of frequency higher than a predetermined frequency in an audio signal that is input, and a hearing aid processor which performs hearing aid processing on a signal output from the high band attenuation filter, wherein the predetermined frequency is determined according to an upper limit of a target bandwidth of frequency for hearing aid. Since such a high band attenuation filter attenuates signal components in a high bandwidth of frequency in broadband audio signals, the signals output from the high band attenuation filter are subjected to the hearing aid processing. Accordingly, the broadband audio signals output from television sets and optical disk players are subjected to the hearing aid processing with high precision.

The signal processing device may further include a compression encoder which performs compression encoding the signal subjected to the hearing aid processing in the hearing aid processor, and a first communication unit which transmits the signal compression encoded in the compression encoder, wherein the compression encoder assigns a larger number of encoding bits to a signal component in the target bandwidth of frequency for hearing aid than to signal components in other bandwidths of frequency in the signal, and performs compression encoding the signal. Thereby, the signal components in the target bandwidth of frequency for hearing aid having a larger number of encoding bits than those of the signal components in other bandwidths of frequency are compression encoded. For this reason, the signal subjected to the hearing aid processing is compression encoded while high quality of sounds to be reproduced is kept.

To solve the problems, the signal processing device according to another aspect of the present disclosure may include a hearing aid processor which performs hearing aid processing to an audio signal that is input, a compression encoder which performs compression encoding a signal subjected to the hearing aid processing in the hearing aid processor, and a first communication unit which transmits the signal compression encoded in the compression encoder, wherein the hearing aid processor transmits an upper limit frequency in a target bandwidth of frequency for hearing aid to the compression encoder, and based on the frequency transmitted from the hearing aid processor, the compression encoder assigns a larger number of encoding bits to a signal component in the target bandwidth of frequency for hearing aid than to signal components in other bandwidths of frequency in the signal, and performs compression encoding the signal. Thereby, the high band attenuation filter attenuates signal components in a high bandwidth of frequency. As a result, instead of automatic assignment of a large number of encoding bits to the signal components in the bandwidth of frequency in which the hearing aid processing is performed, the upper limit frequency of the target bandwidth of frequency for hearing aid is transmitted to the compression encoder to specify the bandwidth of frequency in which the number of encoding bits is assigned. Accordingly, without any high band attenuation filter, the signals subjected to the hearing aid processing are compression encoded while high quality of sounds to be reproduced is kept.

The signal processing device may further include a second communication unit which receives the signal from the first communication unit, a decoder which decodes the signal received by the second communication unit into an audio signal, and a speaker which reproduces the audio signal decoded in the decoder, wherein the second communication unit, the decoder, and the speaker are integrated, and are independent from a main apparatus comprising at least the high band attenuation filter, the hearing aid processor, the compression encoder, and the first communication unit. Thereby, since the signals subjected to the hearing aid processing are reproduced from a speaker near listeners who need the hearing aid processing, listeners who need hearing aid and listeners who do not need the hearing aid can enjoy contents at the same time.

The first communication unit may further have a reception function; the second communication unit may transmit and receive signals to and from the first communication unit; the signal processing device may further include a specifier which specifies information on whether the hearing aid processing is needed or not; the second communication unit may transmit the information specified in the specifier to the first communication unit; and in the case where the information received is information indicating that the hearing aid processing is not needed, the first communication unit may transmit, to the second communication unit, the audio signal that is input to the signal processing device, and in the case where the information received is information indicating that the hearing aid processing is needed, the first communication unit may transmit the signal subjected to the hearing aid processing in the hearing aid processor to the second communication unit. Thereby, since the specifier specifies whether the hearing aid processing is needed or not, in the case where hearing aid is needed, the signals subjected to the hearing aid processing are compression encoded while high quality of sounds to be reproduced is kept, and in the case where hearing aid is not needed, the original broadband signals are reproduced.

Moreover, at least one of the high band attenuation filter and the hearing aid processor may stop operation in the case where the information received by the first communication unit is information indicating that the hearing aid processing is not needed. Thereby, in the case where hearing aid is not needed, at least one of the high band attenuation filter and the hearing aid processor stops operation to save power consumption to be needed for the processing or reduce operational resources to be needed for the processing.

The signal processing device may further include a second communication unit which receives the signal from the first communication unit, a decoder which decodes the signal received by the second communication unit into an audio signal, and a speaker which reproduces the audio signal decoded in the decoder, wherein the second communication unit, the decoder, and the speaker are integrated, and are independent from a main apparatus including at least the high band attenuation filter, the hearing aid processor, the compression encoder, and the first communication unit; the first communication unit further has a reception function; the second communication unit transmits and receives signals to and from the first communication unit; the signal processing device further comprises a specifier which specifies information on whether the hearing aid processing is needed or not; the second communication unit transmits the information specified in the specifier to the first communication unit; in the case where the information received is information indicating that the hearing aid processing is not needed, the first communication unit transmits, to the second communication unit, the audio signal that is input to the signal processing device; in the case where the information received is information indicating that the hearing aid processing is needed, the first communication unit transmits the signal subjected to the hearing aid processing in the hearing aid processor to the second communication unit; and the hearing aid processor stops operation in the case where the information received by the first communication unit is information indicating that the hearing aid processing is not needed. Thereby, in the case where hearing aid is not needed, the hearing aid processor stops operation to save power consumption to be needed for the processing or reduce operational resources to be needed for the processing.

The predetermined frequency may be 8 kHz to 12 kHz. Thereby, broadband audio signals are subjected to the hearing aid processing while the main bandwidth of frequency for sounds used in television broadcasting is ensured.

To solve the problems, the signal processing method according to one aspect of the present disclosure comprises attenuating at least a signal component in a bandwidth of frequency higher than a predetermined frequency in an audio signal that is input, and performing hearing aid processing on a signal processed in the attenuating, wherein the predetermined frequency is determined according to an upper limit of a target bandwidth of frequency for hearing aid. Since signal components in a high bandwidth of frequency in broadband audio signals are attenuated in the attenuating, the signals output from the high band attenuation filter are subjected to the hearing aid processing. Accordingly, the broadband audio signals output from television sets and optical disk players are subjected to the hearing aid processing with high precision.

To solve the problems, the signal processing method according to the present disclosure comprises performing hearing aid processing on an audio signal that is input in a hearing aid processor, compression encoding a signal subjected to the hearing aid processing in a compression encoder, and transmitting the signal compression encoded in the compression encoding, wherein in the hearing aid processing, an upper limit frequency of a target bandwidth of frequency for hearing aid is transmitted to the compression encoder, and in the compression encoding, based on the frequency transmitted from the hearing aid processor, the compression encoder assigns a larger number of encoding bits to a signal component in a target bandwidth of frequency for hearing aid than signal components in other bandwidths of frequency in the signal, and performs compression encoding the signal. Thereby, signal components in a high bandwidth of frequency are attenuated in the attenuating. As a result, instead of automatic assignment of a large number of encoding bits to signal components in a bandwidth of frequency in which the hearing aid processing is performed, the upper limit frequency of the target bandwidth of frequency for hearing aid is transmitted to the compression encoder to specify the bandwidth of frequency in which the number of encoding bits is assigned. Accordingly, without any high band attenuation filter, signals subjected to the hearing aid processing can be compression encoded while high quality of sounds to be reproduced is kept.

Advantageous Effects

The signal processing device and the signal processing method according to the present disclosure perform hearing aid processing on broadband audio signals output from television sets and optical disk players with high precision, and perform compression encoding signals subjected to the hearing aid processing while high quality of sounds to be reproduced is kept.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENTS

The signal processing device and signal processing method according to one aspect of the present disclosure will now be described in detail with reference to the drawings.

Embodiments described below all represent specific examples of the present disclosure. Numeric values, shapes, materials, components, positions of components arranged, forms of connection of components, steps, and order of steps described in the following embodiments are only illustrative, and should not be construed as limitation on the present disclosure. Among the components described in the following embodiments, components not described in an independent claim representing the most superordinate concept of the present invention will be described as arbitrary components.

Figure 1:
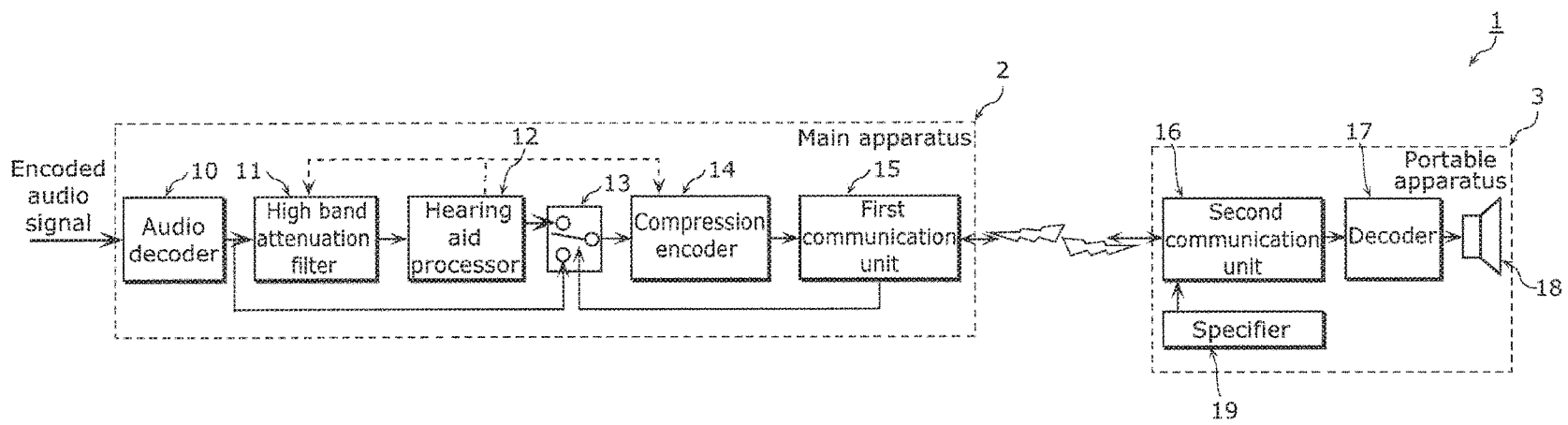
FIG. 1 is a diagram illustrating a configuration of a signal processing device according to an embodiment.

FIG. 1 is a configuration of a signal processing device 1 in the present embodiment.

In FIG. 1, the signal processing device 1 according to the present embodiment can perform hearing aid processing on broadband audio signals with high precision, and perform compression encoding on the signals subjected to the hearing aid processing while high quality of sounds to be reproduced is kept. The signal processing device 1 enables listeners who need such hearing aid processing and listeners who do not need the hearing aid processing to enjoy contents together at the same time. The signal processing device 1 includes a main apparatus 2 and a portable apparatus 3.

The main apparatus 2 is a television set, for example, including an audio decoder 10, a high band attenuation filter 11, a hearing aid processor 12, a switch 13, a compression encoder 14, and a first communication unit 15.

The portable apparatus 3 is a portable housing (such as a portable speaker) independent from the main apparatus 2. The portable apparatus 3 includes a second communication unit 16, a decoder 17, a speaker 18, and a specifier 19.

The audio decoder 10 is a circuit which converts input encoded audio signals to pulse code modulation (PCM) signals. The encoded audio signals input here are encoded audio signals input from TV broadcasting, encoded audio signals input from contents in DVDs and BDs, or encoded audio signals input from audio visual (AV) contents delivered through the Internet. These encoded audio signals are encoded broadband audio signals having a sampling frequency of 32 kHz or more (reproduction bandwidth: 16 kHz or more). Typically, the sampling frequency of digital TV broadcasting is 48 kHz (reproduction bandwidth: 24 kHz), and the sampling frequency of the DVD and BD contents is 48 kHz/96 kHz/192 kHz (reproduction bandwidth: 24 kHz/48 kHz/96 kHz, respectively). The main input signals in the present disclosure have such a bandwidth of frequency.

The high band attenuation filter 11 is a circuit which attenuates at least a signal component in a bandwidth of frequency higher than a predetermined frequency (cutoff frequency) in a broadband audio signal that is input. The predetermined frequency is determined according to the upper limit of the target bandwidth of frequency for hearing aid.

Figure 7:
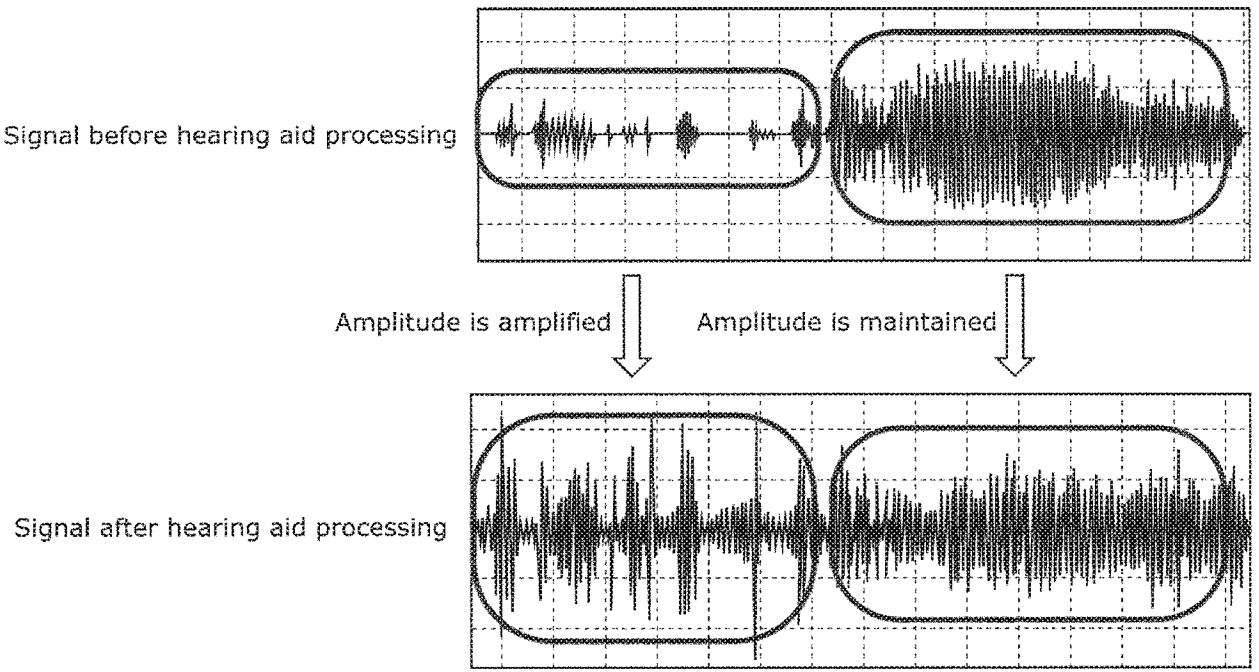
FIG. 7 is a diagram illustrating a basic operation of hearing aid processing.
Figure 8:
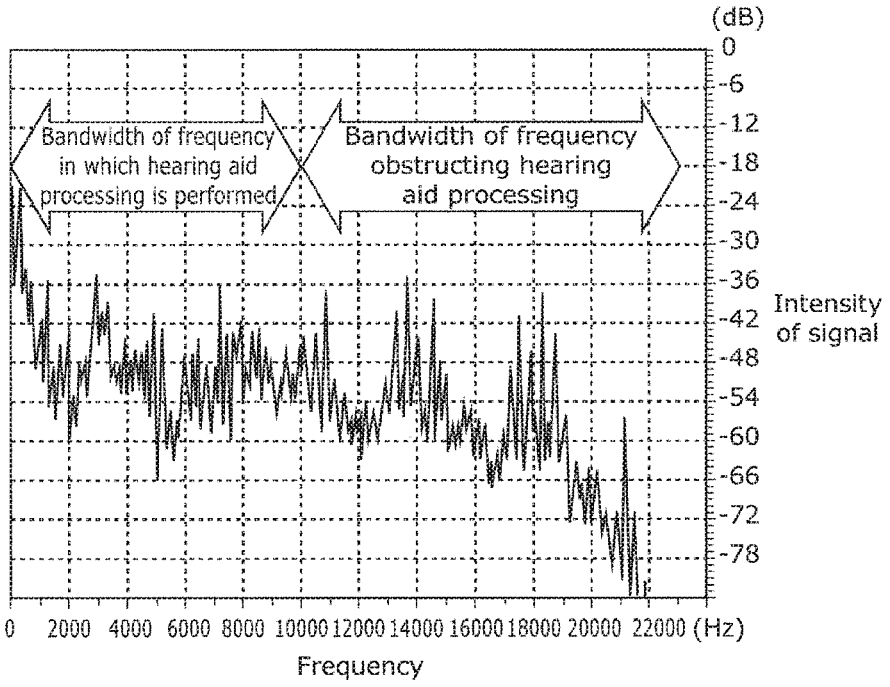
FIG. 8 is a spectrum illustrating the target bandwidth of frequency of a broadband signal for hearing aid.

The hearing aid processor 12 is a circuit which performs the hearing aid processing on a signal output from the high band attenuation filter 11. In other words, as illustrated in FIG. 7, the hearing aid processor 12 compensates for the sense of hearing of persons who have narrowed dynamic ranges for perception of sounds (or normally hear loud sounds but do not hear small sounds) through amplification of signals having small amplitudes and maintenance of the amplitudes of signals having large amplitudes.

The switch 13 is a circuit which transmits one of these two input signals to the subsequent stage.

The compression encoder 14 is a circuit which performs compression encoding the signal subjected to the hearing aid processing in the hearing aid processor 12. The compression encoder 14 employs a compression encoding method according to the Bluetooth (registered trademark) standards, such as an SBC or AAC method, which performs bit assignment on signals in a frequency domain according to the signals.

The first communication unit 15 transmits the signal compression encoded in the compression encoder 14, and receives a signal from a second communication unit 16 described later. The first communication unit 15 is, for example, a communication interface which transmits and receives wireless radio waves according to the Bluetooth (registered trademark) standards.

These components are included in the main apparatus ("main apparatus 2", such as a television set).

The second communication unit 16 transmits and receives signals to and from the first communication unit 15. The second communication unit 16 is, for example, a communication interface which transmits and receives wireless radio waves according to the Bluetooth (registered trademark) standards.

The decoder 17 is a circuit which decodes the signal received by the second communication unit 16 into an audio signal. The decoder 17 employs a decoding method corresponding to the compression encoding method used in the compression encoder 14.

The speaker 18 converts the audio signal decoded in the decoder 17 into an acoustic signal, and reproduces the acoustic signal.

The specifier 19 is a circuit which specifies whether the hearing aid processing is needed or not.

The second communication unit 16 to the specifier 19 are integrally built in a housing ("portable apparatus 3", such as a portable speaker) independent from the main apparatus 2 (such as a television set).

The operation of the signal processing device 1 according to the present embodiment having such a configuration will now be described.

The audio decoder 10 first converts an input encoded audio signal into a PCM signal. The audio decoder 10 employs a decoding method according to the encoding standards of the input encoded audio signal.

Figure 2:
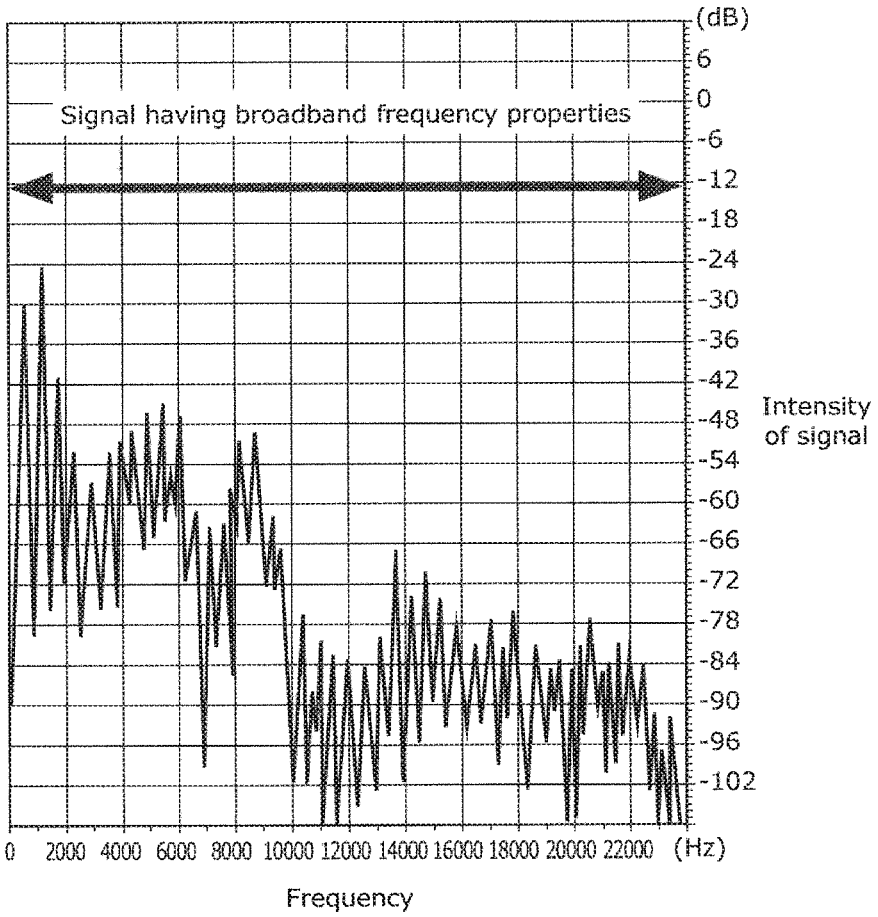
FIG. 2 is a spectrum illustrating exemplary frequency properties of a signal output from an audio decoder.

FIG. 2 is a spectrum illustrating exemplary frequency properties of the signal output from the audio decoder 10. As illustrated in FIG. 2, the signals to be reproduced in the present embodiment are broadband signals in the reproduction bandwidth of 24 kHz.

In the next step, among the signal components of the input broadband audio signal, the high band attenuation filter 11 attenuates the signal components having frequencies higher than the bandwidth of frequency to be treated in the hearing aid processor 12. For this attenuation, the hearing aid processor 12 notifies the high band attenuation filter 11 in which bandwidth of frequency the signal components are subjected to the hearing aid processing. In other words, the cutoff frequency for the high band attenuation filter 11 is determined according to the upper limit of the target bandwidth of frequency for hearing aid. In FIG. 1, the dotted line from the hearing aid processor 12 to the high band attenuation filter 11 represents the notification of the upper limit of the target bandwidth of frequency for hearing aid. In the case where the hearing aid processor 12 performs the hearing aid processing only by a predetermined method, the high band attenuation filter 11 may receive no notification of the upper limit of the target bandwidth of frequency for hearing aid from the hearing aid processor 12. In other words, the cutoff frequency of the high band attenuation filter 11 may be preset according to a predetermined bandwidth of frequency to be treated in the hearing aid processor 12. Accordingly, because the cutoff frequency of the high band attenuation filter 11 is preset in this case, the step represented by the dotted line from the hearing aid processor 12 to the high band attenuation filter 11 in FIG. 1 is unnecessary.

Figure 3:
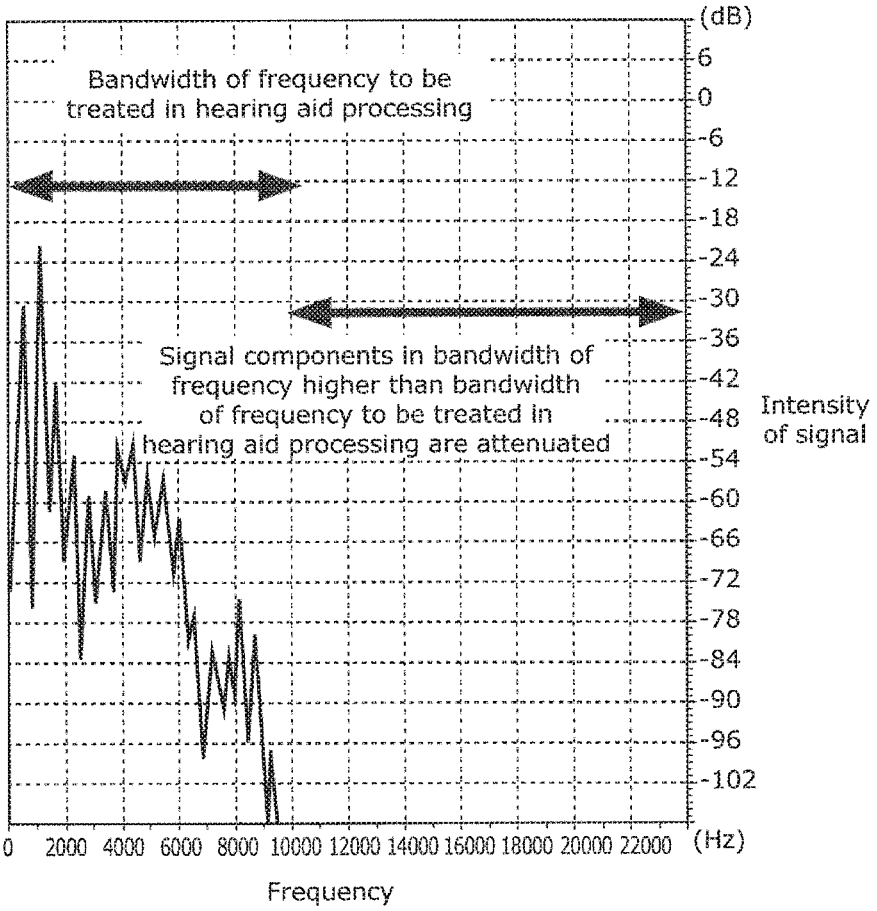
FIG. 3 is a spectrum illustrating exemplary frequency properties of a signal output from a high band attenuation filter.

FIG. 3 is a spectrum illustrating exemplary frequency properties of the signal output from the high band attenuation filter 11.

In the present embodiment, the upper limit of the target bandwidth of frequency for hearing aid in the hearing aid processor 12 is 8 kHz. The signal having the frequency properties illustrated in FIG. 2 has frequency properties illustrated in FIG. 3 as a result of attenuation of the signal components equal to or greater than the bandwidth of frequency of 8 kHz, which is determined according to the upper limit of the target bandwidth of frequency for hearing aid. A typical filter which attenuates signal components in a specific bandwidth of frequency, however, does not have completely sharp attenuation characteristics. Accordingly, the high band attenuation filter 11 of the present embodiment causes residual signal components in the bandwidth of frequency of 8 kHz or more, and slightly attenuates signal components in the bandwidth of frequency of 8 kHz or less.

Figure 9:
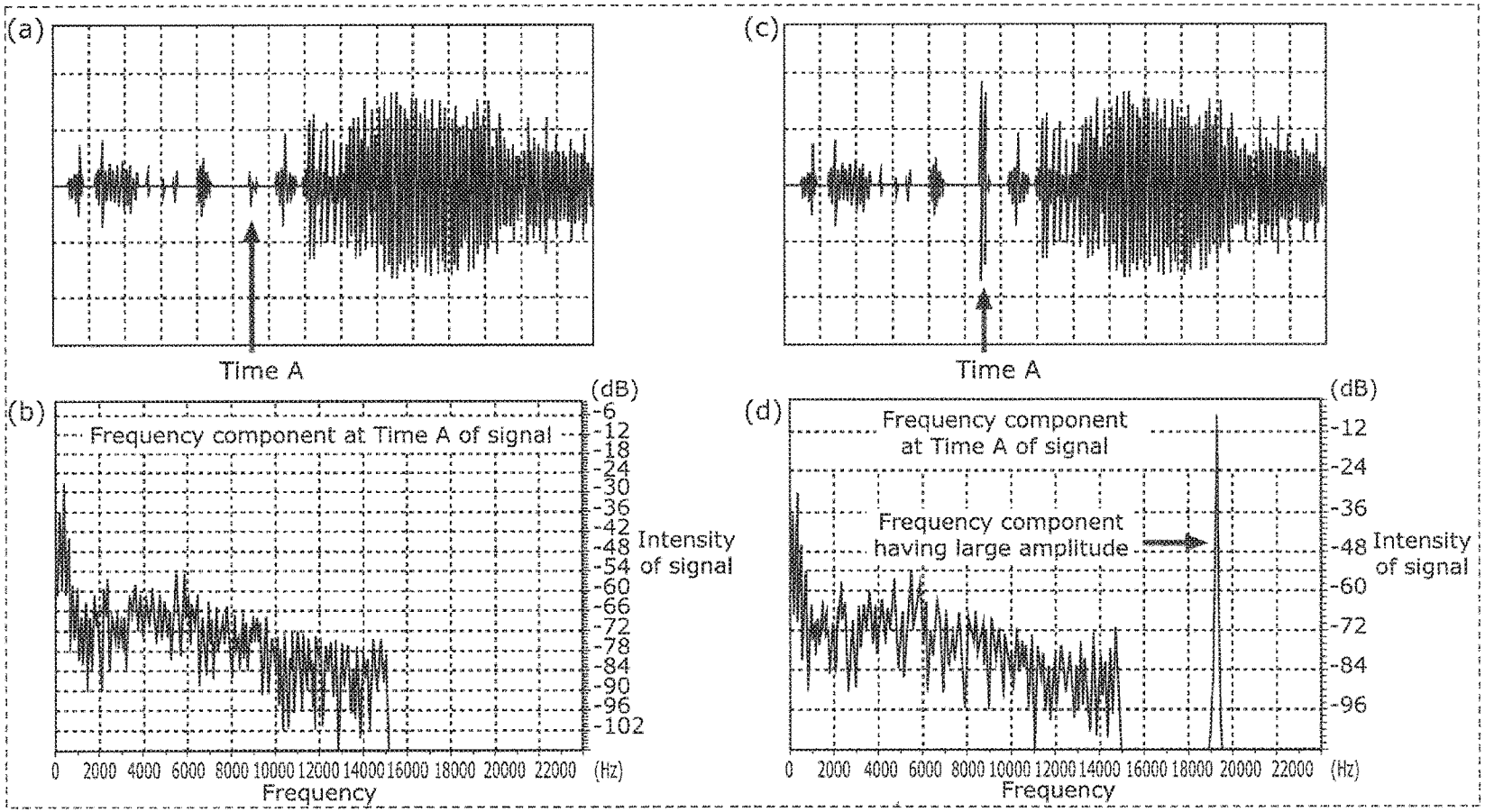
FIG. 9 is a diagram illustrating exemplary frequency components obstructing the hearing aid processing.
Figure 10:
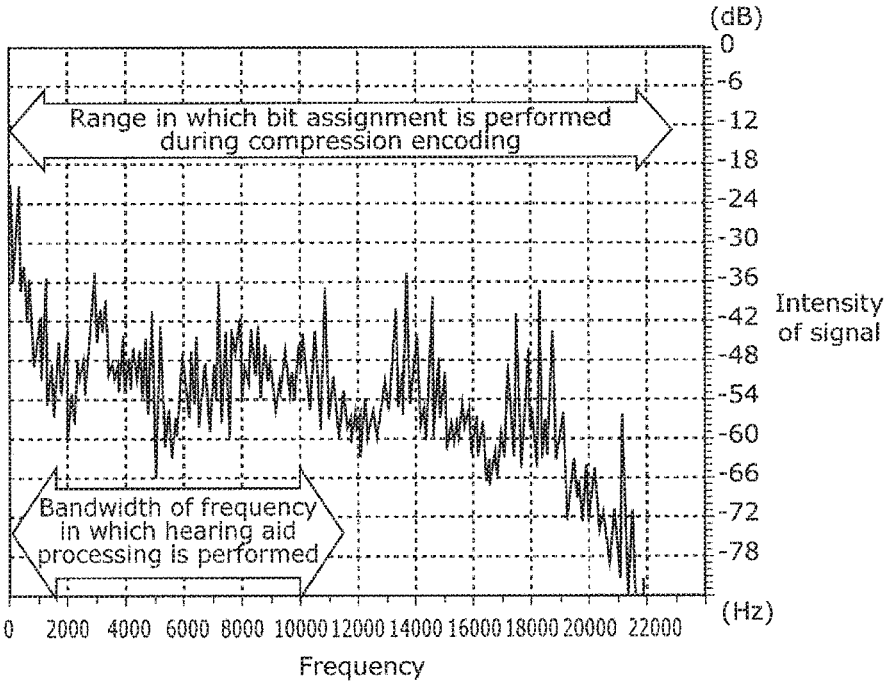
FIG. 10 is a spectrum illustrating a target bandwidth of frequency for bit assignment to broadband signals in the compression encoding.

In the next step, the hearing aid processor 12 performs the hearing aid processing on the signal output from the high band attenuation filter 11. The method for performing the hearing aid processing may be any known method. The basic operation illustrated in FIG. 7 above is to amplify signals having small amplitudes and maintain the amplitude of the signals having large amplitudes. If any signal component having a large amplitude is present in a bandwidth of frequency higher than the target bandwidth of frequency for hearing aid in the signal output from the audio decoder 10, the signal component having a large amplitude does not obstruct the hearing aid processing because the signal component is attenuated by the high band attenuation filter 11. In other words, the signal components having large amplitudes are attenuated in both of signals having the states as illustrated in (a) and (b) of FIG. 9 above. As a result, these signals are not treated as signals having large amplitudes, and thus do not obstruct the hearing aid processing.

Figure 4:
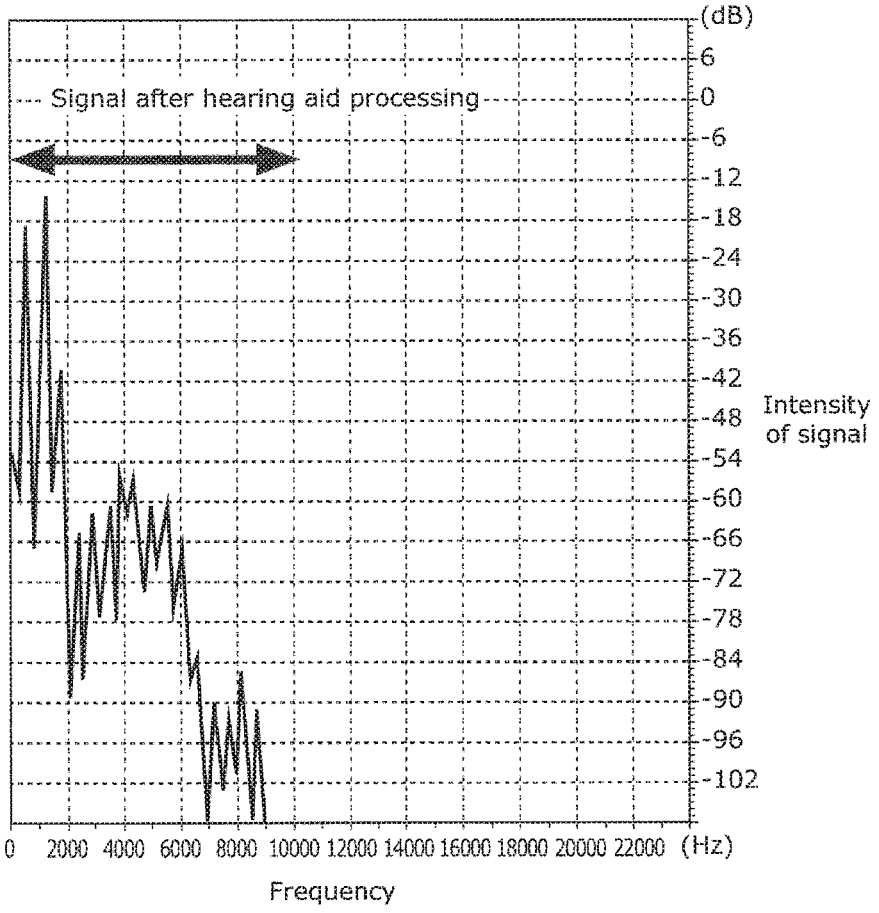
FIG. 4 is a spectrum illustrating exemplary frequency properties of a signal output from a hearing aid processor.

FIG. 4 is a spectrum illustrating exemplary frequency properties of the signal output from the hearing aid processor 12.

The hearing aid processing is typically performed on the signal components in the bandwidth of frequency of about 10 kHz or less. An optimal bandwidth of frequency for performing the hearing aid processing varies between individuals. The bandwidth of frequency for performing the hearing aid processing may be about 8 kHz or less, or may be about 12 kHz or less. The upper limit of the bandwidth of frequency is notified of the high band attenuation filter 11 to be reflected in the characteristics of the high band attenuation filter 11. In the present embodiment, the target bandwidth of frequency to be treated in the hearing aid processor 12 is 8 kHz or less. Then, the high band attenuation filter 11 attenuates signal components in the bandwidth of frequency higher than the notified frequency (8 kHz in this case), as illustrated in FIG. 3. The hearing aid processor 12 then performs the hearing aid processing on the signal, in which the signal components in the bandwidth of frequency higher than 8 kHz have been attenuated, to output a signal having the frequency properties illustrated in FIG. 4 from the hearing aid processor 12.

In the next step, one of the signal output from the hearing aid processor 12 and the signal output from the audio decoder 10 is transmitted through the switch 13 to the compression encoder 14 in the following stage. The operation when the switch 13 selects and transmits the signal output from the hearing aid processor 12 to the compression encoder 14 will now be described.

The compression encoder 14 then performs compression encoding the signal subjected to the hearing aid processing in the hearing aid processor 12 and transmitted from the switch 13.

Figure 5:
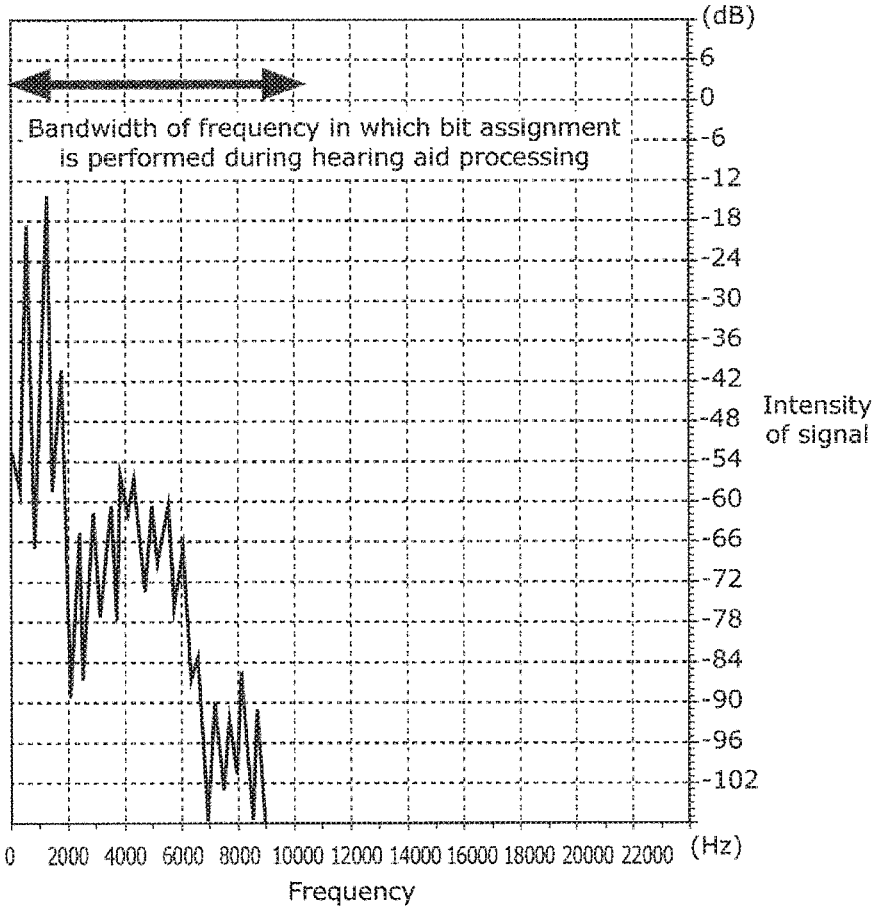
FIG. 5 is a spectrum illustrating an exemplary bandwidth of frequency in which bit assignment is performed by a compression encoder.

FIG. 5 is a spectrum illustrating the bandwidth of frequency in which bit assignment is performed in the compression encoder 14.

In the present embodiment, the bandwidth of frequency to be treated in the hearing aid processor 12 is 8 kHz or less, and is reflected in the high band attenuation filter 11. As a result, the high band attenuation filter 11 attenuates signals at 8 kHz or more. As illustrated in FIG. 5, because the input signal to the compression encoder 14 barely has signal components in a high range of 8 kHz or more, the compression encoder 14 automatically assigns a larger number of bits to the target signal components for hearing aid in the bandwidth of frequency of not more than 8 kHz than to the signal components in other bandwidths of frequency. In other words, the high band attenuation filter 11 also functions to induce assignment of a large number of bits in the compression encoder 14 to the signal components in the bandwidth of frequency in which the hearing aid processing is performed.

The compression encoder 14 may directly take the information of the bandwidth of frequency to be treated in the hearing aid processor 12. In this case, in FIG. 1, the information of the bandwidth of frequency to be treated in the hearing aid processor 12 is transmitted through the route represented by the dotted line from the hearing aid processor 12 to the compression encoder 14.

The first communication unit 15 then transmits the signal compression encoded in the compression encoder 14 to the second communication unit 16.

The operations of the components integrated in the main apparatus 2 (such as a television set) have been described.

The operation of the portable apparatus 3 configured independently from the main apparatus 2 will now be described. The portable apparatus 3 is an apparatus which can be carried (such as a portable speaker), and is supposed to be placed on the laps of elderly persons or desks which elderly persons use.

The second communication unit 16 first receives the signal transmitted from the first communication unit 15.

The decoder 17 then generates an audio signal by decoding the signal received by the second communication unit 16 into the audio signal using a decoding method corresponding to the compression encoding method used in the compression encoder 14.

The speaker 18 then converts the audio signal decoded in the decoder 17 into an acoustic signal to reproduce the acoustic signal.

A speaker (such as a speaker built in a television set), which is not illustrated in FIG. 1, is attached to the main apparatus 2. The speaker attached to the main apparatus 2 reproduces the signals output from the audio decoder 10 as acoustic signals. In contrast, the speaker 18 reproduces the acoustic signals subjected to the hearing aid processing near elderly persons. As a result, the elderly persons listen to the sounds reproduced from the acoustic signals from the speaker 18 of the portable apparatus 3 while healthy persons listen to the sounds reproduced from the acoustic signals from the speaker of the main apparatus 2. The elderly persons and the healthy persons thereby can enjoy sounds reproduced from the audio signals suitable for them.

Finally, the role of the specifier 19 will be described.

The specifier 19 specifies whether the hearing aid processing is needed or not. The information specified in the specifier 19 is transmitted to the second communication unit 16, and then is transmitted from the second communication unit 16 to the first communication unit 15. The first communication unit 15 transmits the information specified in the specifier 19 to the switch 13. In the case where the information received in the first communication unit 15 indicates that the hearing aid processing is needed, the switch 13 is activated, and narrowband audio signals subjected to the hearing aid processing in the hearing aid processor 12 are compression encoded in the compression encoder 14, and are transmitted to the first communication unit 15. In the case where the information received in the first communication unit 15 indicates that the hearing aid processing is not needed, the switch 13 is not activated, and broadband audio signals input to the signal processing device 1 and decoded in the audio decoder 10 are compression encoded in the compression encoder 14, and are transmitted to the first communication unit 15. The portable apparatus 3 further includes a switch (not illustrated in FIG. 1) which turns on and off to specify whether the hearing aid processing is needed or not, for example. In other words, the elderly persons who need the hearing aid processing turn on the switch provided with the portable apparatus 3. The healthy persons who do not need the hearing aid processing turn off the switch provided with the portable apparatus 3. The listeners who listen to sounds reproduced from the acoustic signals in the portable apparatus 3 turn on and off the hearing aid processing with the switch provided with the portable apparatus 3 at hand. In the case where the hearing aid processing is turned off, the signals which bypass the high band attenuation filter 11 are output from the main apparatus 2, and are reproduced from the speaker 18. For this reason, the healthy persons can enjoy sounds reproduced from broadband acoustic signals through the portable apparatus 3.

In the case where the information received in the first communication unit 15 indicates that the hearing aid processing is not needed, at least one of the high band attenuation filter 11 and the hearing aid processor 12 stops operation to save the power consumption or reduce use of operational resources.

As above, according to the signal processing device 1 in the present embodiment, of broadband audio signals, the signal components in a bandwidth of high frequency are attenuated in the high band attenuation filter 11, and are subjected to the hearing aid processing in the hearing aid processor 12. In the compression encoder 14, a larger number of encoding bits are assigned to the signal components in the target bandwidth of frequency for hearing aid than to signal components in other bandwidths of frequency in the signal, and the signal is compression encoded. As a result, broadband audio signals output from television sets and optical disk players are subjected to the hearing aid processing with high precision, and the signals subjected to the hearing aid processing are compression encoded while high quality of sounds to be reproduced is kept.

The listeners who need hearing aid listen to sounds reproduced from the acoustic signals through the hearing aid processing with the speaker 18 of the portable apparatus 3 located near the listeners who need hearing aid, and the listeners who do not need hearing aid listen to sounds reproduced from the normal acoustic signals with the speaker attached to the main apparatus 2. As a result, the listeners who need hearing aid and those who do not need hearing aid can enjoy the same content together at the same time.

While the signal processing device 1 according to the present disclosure has been described based on one embodiment, this embodiment should not be construed as limitation of the present disclosure. The appended Claims are of a scope intended to cover and encompass not only the particular embodiment disclosed, but also equivalent structures, methods, and/or uses.

For example, while the signal processing device 1 in the embodiment above includes the high band attenuation filter 11, the high band attenuation filter 11 is not always included.

Figure 6:
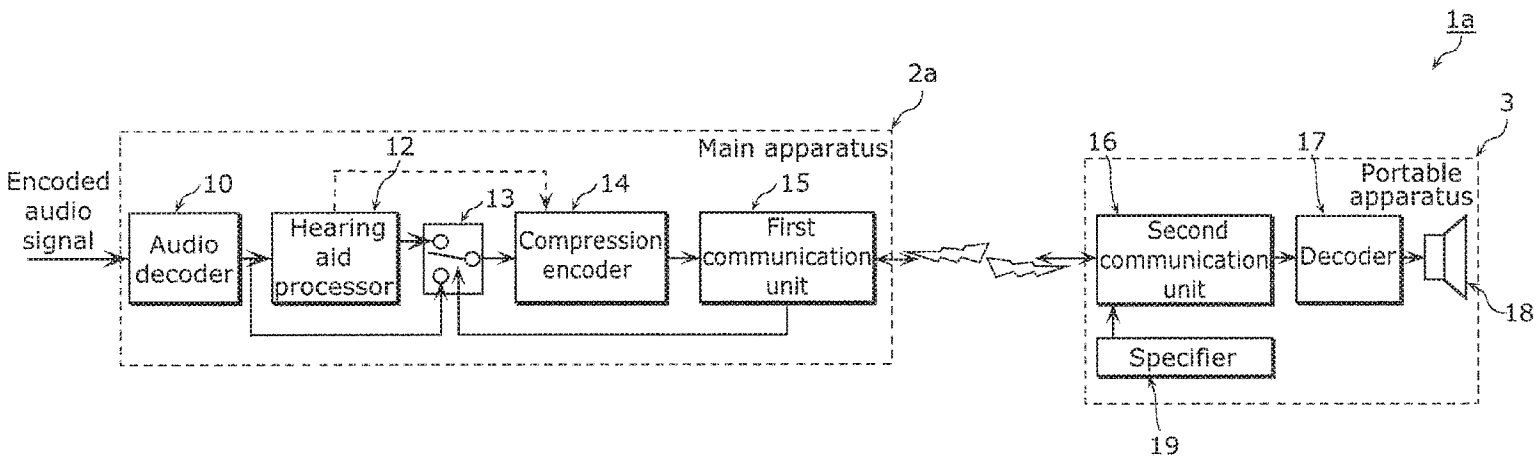
FIG. 6 is a diagram illustrating a configuration of a signal processing device including no high band attenuation filter.

FIG. 6 is a diagram illustrating a configuration of a modification of the signal processing device in the present embodiment, or a signal processing device 1*a* not including the high band attenuation filter 11. The signal processing device 1*a* performs the hearing aid processing on broadband audio signals with high precision, and performs compression encoding the signals subjected to the hearing aid processing while high quality of sounds to be reproduced is kept. The signal processing device 1*a* enables the listeners who need the hearing aid processing and those who do not need the hearing aid processing to enjoy the contents together at the same time. Unlike the signal processing device 1 illustrated in FIG. 1, the signal processing device 1*a* in FIG. 6 includes a main apparatus 2*a* instead of the main apparatus 2. In FIG. 6, the same reference numbers are given to the same components as those illustrated in FIG. 1, and the description thereof will be omitted.

The main apparatus 2*a* is, for example, a television set, and includes an audio decoder 10, a hearing aid processor 12, a switch 13, a compression encoder 14, and a first communication unit 15.

The signal processing device 1*a* includes a main apparatus 2*a* including the components other than the high band attenuation filter 11, which are included in the main apparatus 2 of the signal processing device 1 illustrated in FIG. 1. In such a signal processing device, the hearing aid processor 12 transmits the upper limit frequency in the target bandwidth of frequency for hearing aid to the compression encoder 14 to specify the bandwidth of frequency in which encoding bits are to be assigned. Accordingly, without the high band attenuation filter 11, the signals subjected to the hearing aid processing are compression encoded while high quality of sounds to be reproduced is kept.

Moreover, the present disclosure can be implemented as a signal processing device in the embodiment above, and may be implemented as a signal processing method. The signal processing method comprises attenuating at least a signal component in a bandwidth of frequency higher than a predetermined frequency in an audio signal that is input, and performing hearing aid processing on a signal processed in the high band attenuation, wherein the predetermined frequency is determined according to the upper limit of the target bandwidth of frequency for hearing aid. The signal processing method may comprise performing hearing aid processing on an audio signal that is input in the hearing aid processor 12, compression encoding a signal, which is subjected to the hearing aid processing in the hearing aid processing, in the compression encoder 14, and transmitting the signal compression encoded in the compression encoding, wherein in the hearing aid processing, the hearing aid processor 12 transmits the upper limit frequency in a target bandwidth of frequency for hearing aid to the compression encoder 14; and in the compression encoding, the compression encoder 14 assigns a larger number of encoding bits to a signal component in the target bandwidth of frequency for hearing aid than to signal components in other bandwidths of frequency based on the upper limit frequency transmitted from the hearing aid processor 12. In such a signal processing method, the signal components in a high bandwidth of frequency in the broadband audio signals are attenuated through the high band attenuation filter 11, and are subjected to the hearing aid processing in the hearing aid processor 12. In the compression encoder 14, a larger number of encoding bits are assigned to the signal component in the target bandwidth of frequency for hearing aid that to the signal components in other bandwidths of frequency in the signal, and the signal is compression encoded. As a result, the broadband audio signals output from television sets and optical disk players are subjected to the hearing aid processing with high precision, and the signals subjected to the hearing aid processing are compression encoded while high quality of sounds to be reproduced is kept.

Moreover, such a signal processing method may be implemented as a program to be executed in a processor, such as a digital signal processor (DSP). Such a program can be stored in a computer-readable recording medium such as DVD.

In the present embodiment, the bandwidth of frequency to be treated in the hearing aid processor 12 is 8 kHz or less. Any other bandwidth of frequency, for example, 12 kHz or less, may be treated in the hearing aid processor 12. Accordingly, the cutoff frequency of the high band attenuation filter 11 may be 8 kHz to 12 kHz because the cutoff frequency of the high band attenuation filter 11 is determined according to the upper limit of the target bandwidth of frequency for hearing aid.

In the present embodiment, for easy and simple explanation, a listener who needs the hearing aid processing is referred to as an elderly person, and a listener who does not need the hearing aid processing is referred to as a healthy person. It should be noted, however, that elderly persons do not always need the hearing aid processing, and younger listeners need the hearing aid processing.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

INDUSTRIAL APPLICABILITY

The signal processing device according to the present disclosure is broadly applicable to digital AV apparatuses.

The invention claimed is:

1. A signal processing device, comprising:

a high band attenuation filter which attenuates at least a signal component of an audio signal, which has not been frequency shifted, in a bandwidth of frequency higher than a predetermined frequency, the audio signal being input into the high band attenuation filter, and a hearing aid processor which performs hearing aid processing on a signal output from the high band attenuation filter, wherein the predetermined frequency is determined according to an upper limit of a target bandwidth of frequency for hearing aid, and the hearing aid processor amplifies the signal output from the high band attenuation filter when the amplitude of the signal is less than a first amplitude, and does not amplify the signal when the amplitude of the signal is greater than the first amplitude.

2. The signal processing device according to claim 1, further comprising:

a compression encoder which performs compression encoding the signal subjected to the hearing aid processing in the hearing aid processor; and a first communication unit configured to transmit the signal compression encoded in the compression encoder, wherein the compression encoder assigns a larger number of encoding bits to a signal component in the target bandwidth of frequency for hearing aid than to signal components in other bandwidths of frequency in the signal, and performs compression encoding the signal.

3. The signal processing device according to claim 2, further comprising:

a second communication unit configured to receive the signal from the first communication unit;

a decoder which decodes the signal received by the second communication unit into an audio signal; and a speaker which reproduces the audio signal decoded in the decoder, wherein the second communication unit, the decoder, and the speaker are integrated, and are independent from a main apparatus comprising at least the high band attenuation filter, the hearing aid processor, the compression encoder, and the first communication unit.

4. The signal processing device according to claim 3, wherein the first communication unit further has a reception function;

the second communication unit is configured to transmit and receive signals to and from the first communication unit;

the signal processing device further comprises a specifier which specifies information on whether the hearing aid processing is needed or not;

the second communication unit is configured to transmit the information specified in the specifier to the first communication unit; and in the case where the information received is information indicating that the hearing aid processing is not needed, the first communication unit is configured to transmit, to the second communication unit, the audio signal that is input to the signal processing device, and in the case where the information received is information indicating that the hearing aid processing is needed, the first communication unit is configured to transmit the signal subjected to the hearing aid processing in the hearing aid processor to the second communication unit.

5. The signal processing device according to claim 4, wherein at least one of the high band attenuation filter and the hearing aid processor stops operation in the case where the information received by the first communication unit is information indicating that the hearing aid processing is not needed.

6. The signal processing device according to claim 1, wherein the predetermined frequency is 8 kHz to 12 kHz.

7. A signal processing method, comprising:

attenuating at least a signal component in a bandwidth of frequency higher than a predetermined frequency in an audio signal, which has not been frequency shifted, that is input; and performing hearing aid processing on a signal processed in the attenuating, wherein the predetermined frequency is determined according to an upper limit of a target bandwidth of frequency for hearing aid, and the hearing aid processing amplifies the signal processed in the attenuating when the amplitude of the signal is less than a first amplitude, and does not amplify the signal when the amplitude of the signal is greater than the first amplitude.

* * * * *